US008597547B2

(12) United States Patent
Grigorian et al.

(10) Patent No.: US 8,597,547 B2
(45) Date of Patent: Dec. 3, 2013

(54) ELECTRICALLY CONDUCTIVE POLYMER COMPOSITES

(75) Inventors: Leonid Grigorian, Camarillo, CA (US); Chorng-Jeou Chen, Simi Valley, CA (US)

(73) Assignee: Yazaki Corporation, Tokyo (JP)

( * ) Notice: Subject to any disclaimer, the term of this patent is extended or adjusted under 35 U.S.C. 154(b) by 568 days.

(21) Appl. No.: 12/361,262

(22) Filed: Jan. 28, 2009

(65) Prior Publication Data

US 2009/0189125 A1 Jul. 30, 2009

Related U.S. Application Data

(60) Provisional application No. 61/024,136, filed on Jan. 28, 2008.

(51) Int. Cl.
*H01B 1/24* (2006.01)

(52) U.S. Cl.
USPC ..... 252/511; 252/502; 252/510; 524/543

(58) Field of Classification Search
USPC ..... 252/502, 510, 511; 524/495, 496, 543
See application file for complete search history.

(56) References Cited

U.S. PATENT DOCUMENTS

| | | | | |
|---|---|---|---|---|
| 5,776,372 | A * | 7/1998 | Saito et al. | 252/511 |
| 6,746,627 | B2 * | 6/2004 | Niu et al. | 252/511 |
| 2003/0122111 | A1 * | 7/2003 | Glatkowski | 252/500 |
| 2004/0089851 | A1 * | 5/2004 | Wang et al. | 252/500 |
| 2004/0127621 | A1 | 7/2004 | Drzal et al. | |
| 2006/0052509 | A1 * | 3/2006 | Saitoh | 524/496 |
| 2006/0137817 | A1 * | 6/2006 | Ma et al. | 156/296 |
| 2006/0231792 | A1 * | 10/2006 | Drzal et al. | 252/188.28 |
| 2008/0044651 | A1 * | 2/2008 | Douglas | 428/339 |
| 2009/0110806 | A1 * | 4/2009 | Cai et al. | 427/58 |

FOREIGN PATENT DOCUMENTS

WO WO 2004072159 A1 8/2004

OTHER PUBLICATIONS

Titelman, Grigory I. et al., "Electrically conducting coating composition and electrically conductive composite", Research Disclosure Journal, RD 500006, Dec. 2005.

Titelman, Grigory I. et al., "Electrically conducting polymer nanocomposite", Research Disclosure Journal, RD 500009, Dec. 2005.

Titelman, Grigory I. et al., " Electrically conducting polymer nanocomposites", Research Disclosure Journal, RD 500011, Dec. 2005.

* cited by examiner

*Primary Examiner* — Mark Kopec
*Assistant Examiner* — Haidung Nguyen
(74) *Attorney, Agent, or Firm* — Perkins Coie LLP; Viola T. Kung

(57) ABSTRACT

This invention relates to a process for preparing an electrically conductive composite comprising the weight ratio of carbon to polymer of greater than 0.11. The process comprises the steps of mixing non-predispersed carbon with an emulsion comprising a polymer in a liquid solvent to obtain a dispersion of the carbon within the polymer matrix, wherein the weight ratio of carbon to polymer is greater than 0.11; and removing the liquid solvent from the dispersion. The invention also relates to conductive polymer composites prepared by the process.

18 Claims, No Drawings

ELECTRICALLY CONDUCTIVE POLYMER COMPOSITES

This application claims the benefit of U.S. Provisional Application No. 61/024,136, filed Jan. 28, 2008; the contents of which is incorporated herein by reference in its entirety.

TECHNICAL FIELD

This invention relates to a process for preparing an electrically conductive composite by solution compounding method. This invention also relates to the electrically conductive composite made by the process. This invention is illustrated by mixing non-predispersed graphite with a polymer emulsion at the weight ratio of graphite to the polymer greater than 0.11.

BACKGROUND OF THE INVENTION

Electrically conductive polymers have applications in a wide range of commercial fields such as electromagnetic interference (EMI) shielding, electrostatic dissipation, electrostatic painting and re-chargeable batteries.

In general, materials can be divided into three groups regarding their electrical conductivity δ: insulators ($\delta<10^{-7}$ S/m), semi-conductors ($\delta=10^{-7}-10^{5}$ S/m) and conductors ($\delta>10^{5}$ S/m). For polymers, typical conductivity values range from $10^{-15}$ S/m up to $10^{-12}$ S/m. Carbon fillers can have conductivities in the range of $10^{4}$ S/m up to $10^{7}$ S/m.

A non-conducting polymer can gain electrical conductivity by incorporation of highly conductive carbon fillers such as graphite and carbon nanotubes into polymer matrixes.

However, carbon fillers are known to be very difficult to uniformly disperse in polymer composites due to their poor compatibility with polymers. This problem is more severe when inert thermoplastic polymers such as polypropylene (PP) are used.

Surface modification of the fillers, commonly employed to improve compatibility of the filler with the polymer matrix, may adversely affect the intrinsic electrical and thermal properties of the composite.

In summary, there is a need for electrically conductive polymers with high and uniform conductivity. There is also a need for methods for preparation of such composites.

SUMMARY OF THE INVENTION

The present invention is directed to a process for preparing an electrically conductive composite comprising carbon to polymer in a weight ratio of greater than 0.11. The process comprises the steps of first mixing non-predispersed carbon with an emulsion comprising a polymer and a liquid solvent to obtain a dispersion of the carbon within the polymer matrix, wherein the weight ratio of carbon to the polymer is greater than 0.11; and subsequently removing the liquid solvent from the dispersion. This method does not require predispersion of carbon in a liquid medium before mixing with the polymer emulsion.

This invention is also directed to electrically conductive polymer composites comprising a polymer and a carbon in a weight ratio of greater than 0.11, prepared by the present method.

Carbon suitable for the present invention includes carbon that has a high aspect ratio, such as graphite, graphite nanoplatelets, expanded graphite nanoplatelets, carbon fibers, carbon nanotubes, and a mixture thereof.

Polymer suitable for the present invention includes polypropylene, polyethylene, acrylic, vinyl acrylic, styrene acrylic, vinyl ester, vinyl acetate, starches, natural rubbers, synthetic rubbers, latexes, epoxies, and mixtures thereof.

The present method provides electrically conductive polymer composites with uniform carbon dispersion in the polymer matrix. The electrically conductive polymer composites of the present invention provide low surface electrical resistance, and good electromagnetic interference (EMI) shielding performance.

DETAILED DESCRIPTION OF THE INVENTION

This invention is directed to a solution compounding process for preparing an electrically conductive composite comprising a polymer and carbon in a weight ratio of grater than 0.11. The process comprises the steps of first mixing non-predispersed carbon and an emulsion comprising a polymer in a liquid solvent to obtain a dispersion of the carbon within the polymer matrix, and subsequently removing the liquid solvent to obtain a composite at a dry stage. The inventors have discovered that a percolation threshold is reached when the carbon and the polymer ratio is about 0.11 (carbon being 10% w/w of the total amount of carbon and polymer). When the carbon and the polymer ratio is greater than 0.11 (carbon being >10% w/w), the electrically conductive composite prepared by this process provides more uniform carbon dispersion, more uniform surface electrical resistance, and superior EMI shielding effectiveness as compared with the composite prepared by the traditional compounding method.

The polymer may be any polymer suitable for the invention. The polymer is preferably a polymer that is easily dispersed in a liquid solution. Examples of such polymers may include acrylic, vinyl acrylic, styrene acrylic, vinyl ester, vinyl acetate, epoxies, starches, natural rubbers, synthetic rubbers and mixtures thereof. Examples of such polymers also include polymer emulsions such as aqueous emulsions of polypropylene, polyethylene, or latex solutions. More than one polymer emulsion may be used in the preparation of these composites.

Many forms of carbon are suitable for this invention. These forms of carbon include for example amorphous carbon, graphite, carbon nanotubes, or a mixture thereof. The carbon may be a carbon that has a high aspect ratio, such as graphite, graphite nanoplatelets, expanded graphite nanoplatelets (exfoliated graphite nanoplatelets), carbon fibers, and carbon nanotubes. For example, the carbon may be graphite or a mixture of graphite and carbon nanotubes.

Any forms of graphite are suitable for this invention. Expanded graphite nanoplatelets (also called exfoliated graphite nanoplatelets) are preferred. Expanded graphite nanoplatelets are commercially available from Angstron Materials (Dayton, Ohio) and XG Sciences (East Lansing, Mich.). Expanded graphite nanoplatelets can also be prepared from expandable graphites, which are commercially available from GrafTech International Holdings Inc. (Parma, Ohio). Expandable graphite can be processed to obtain expanded graphite nanoplatelets. For example, commercially available expandable graphite (e.g. GrafTech Grafguard 160-50N) consists of graphite layers with acid intercalants. When heated, the acid decomposes and expands, causing the graphite layers to expand or exfoliate, creating expanded graphite nanoplatelets, which are then washed with water to remove the residual acid.

The composites comprising only the graphite form of carbon may provide relatively inexpensive products, as compared to the composites comprising carbon nanotubes. However, incorporation of carbon nanotubes into the composites comprising the graphite may improve their electrical properties and such composites are also useful. The carbon nanotubes may be multi-wall carbon nanotubes (MWCNT), single wall carbon nanotubes (SWCNT), or a mixture thereof.

The present method comprises first mixing non-predispersed carbon and an emulsion comprising a polymer in a liquid solvent. The liquid solvent may be any solvent such as water or an organic solvent. The carbon is mixed directly with a liquid polymer emulsion. The carbon is not pre-dispersed into a liquid medium before mixing with the polymer emulsion. For example, the carbon powder is added to the liquid polymer emulsion, or the liquid polymer emulsion is added to the carbon powder. The carbon is preferably in a dry form such as dry powders or flakes; however, it may contain moisture or an insignificant amount of residual solvents from the preparation of the carbon material.

This present method does not require pre-dispersion of carbon in a liquid medium before mixing with the polymer emulsion. Such pre-dispersion of carbon often requires surfactants such as a salt of a hydrocarbon sulphate or sulphonate (e.g., sodium dodecyl sulphate (SDS) or sodium dodecyl sulphonate), or a polyalkyleneoxide based surfactant. These kinds of surfactants are often incorporated into the polymer matrixes and cannot be removed from the composite, which results in deterioration of the electrical properties of the composite. The adverse effects of the pre-dispersion of carbon are avoided by the solution compounding method of the present invention.

The non-predispersed carbon and the liquid polymer emulsion are mixed by minimal mechanical agitation such as stirring or shaking, ultrasonication, or combinations thereof, to obtain a fine dispersion of the carbon within the polymer matrix.

The present method further comprises a subsequent drying step of removing the liquid from the carbon-polymer solution to obtain a dry composite. The drying step can be carried out by evaporation, filtration, dialysis, heating, spray drying, freeze-drying, flash drying, or any other conventional solvent removal methods.

In the present method, the weight ratio of carbon to the polymer is greater than 0.11 (carbon being >10% (w/w) of the total amount of carbon and polymer). The weight ratio of carbon to the polymer is preferably equal to or greater than 0.18 (carbon being ≥15% (w/w)), more preferably equal to or greater than 0.25 (carbon being ≥20% (w/w)). In one embodiment, the weight ratio of carbon to the polymer is about 0.25-about 0.43 (carbon being about 20-30% (w/w)). In another embodiment, the weight ratio of carbon to the polymer is about 0.25-about 0.67 (carbon being about 20-40% (w/w)). In another embodiment, the weight ratio of carbon to the polymer is about 0.25-about 1.0 (carbon being about 20-50% (w/w)). In yet another embodiment, the weight ratio of carbon to the polymer is about 0.25-about 1.5 (carbon being about 20-60% (w/w)). The composite obtained by the present method contains the same carbon to polymer ratio as the starting ratio. "Carbon %" as used herein, refers to percent carbon of the total amount of carbon and the polymer. "About" as used herein, refers to ±10% of the value recited.

The present invention is also directed to electrically conductive composites prepared by the solution compounding process of the present invention. The solution compounding method provides electrically conductive polymer composites with more uniform carbon dispersion in the polymer matrix, lower surface electrical resistance, and better electromagnetic interference (EMI) shielding performance, as compared to those prepared by conventional compounding methods such as dry mechanical mixing, melt mixing, and twin-screw extrusion. In general, the electrically conductive composites of the present invention have an average surface electrical resistance ≤100Ω/square, and preferably ≤20Ω/square.

The electrically conductive composite of the present invention can be processed into various forms by various techniques such as injection molding, compression molding, extrusion, etc., for a wide range of commercial applications.

The invention is illustrated further by the following examples that are not to be construed as limiting the invention in scope to the specific procedures or products described in them.

EXAMPLES

Example 1

Preparation of Polypropylene and Graphite Nanoplatelet Composites by Solution Compounding Expandable graphite was purchased from GrafTech International Holdings Inc. (Parma, Ohio) with the catalog number Grafguard 160-50N. This graphite was heated for about 30 minutes at 900° C. in a box furnace. This heating caused formation of worm-like powders that are generally known as expanded graphite nanoplatelets (GNP).

An aqueous emulsion of polypropylene (PP) was purchased from Solvay S.A. (Brussels, Belgium) with the catalog number Priex 802. This is a white milky solution comprising 25 to 28 weight percent (average 26.5 weight percent) of fine powders of PP grafted with maleic anhydride, and less than 5 weight percent of an organic fatty acid that acts as a non-ionic surfactant. The aqueous PP emulsion was used as received.

In the first step of the method, a mixture was prepared as follows: About 10 g of expanded graphite nanoplatelets were placed in a large (1-liter or 2-liter) beaker. An appropriate amount of PP emulsion was then placed into a plastic bottle, and between 500 and 750 ml de-ionized water was added to the bottle. In this example, the amounts of PP emulsion placed into the plastic bottle were chosen as 340, 151, 87.9, 56.6, and 37.7 g, in order to obtain mixtures of graphite and PP with graphite:PP weight ratios of 0.11, 0.25, 0.43, 0.67, and 1.0, respectively.

Then, the PP emulsion and water mixture was added to the graphite, and the mixture was gently stirred to submerge all the graphite in the mixture. An additional 100-250 ml de-ionized water was added to ensure that all graphite was rinsed from the beaker walls into the mixture. The resulting mixture was mixed for about 1 hour with sonication and/or magnetic stirring forming a dispersion of graphite and polymer in the liquid. This mixing procedure also served to remove residual acid from the expanded graphite nanoplatelets by washing.

Then, the water was removed by placing the mixture in a large evaporating dish and drying in an oven at about 60° C. for more than 18 hours. The drying process formed the composites of the invention. Composites with varying amounts of expanded graphite nanoplatelets were thereby prepared, in ratios of graphite:PP of 0.11, 0.25, 0.43, 0.67, and 1.0 (graphite being 10, 20, 30, 40, and 50% w/w respectively.)

These composites were molded by applying a temperature of about 177° C. and pressure of about 6 metric tons for about 2 minutes to produce sheets about 1.4 millimeter thick with a length of about 6 centimeters and a width of about 4 centimeters.

The resultant composite sheets were characterized for their electrical properties as described in Example 4.

Example 2

Preparation of Polypropylene and Graphite Nanoplatelet Composite by Solution Compounding and Further Addition of Polypropylene In this example, a GNP-PP composite was produced with GNP:PP weight ratio of 0.11, by a two-step process. In the first step, a mixture of expanded graphite nanoplatelets in PP emulsion was prepared as described in Example 1. In the second step, additional dry PP powder was added to the mixture and mixed by standard mechanical mixing to produce the final composite material.

To prepare the composite with 0.11 GNP:PP weight ratio, a mixture of 3.01 g expanded graphite nanoplatelets, 26.4 g PP emulsion, and 330 g de-ionized water was first prepared and mixed with sonication (Vibra-Cell VCX600, Sonics & Materials, Newtown, Conn.) for 60 minutes. The mixture was then dried at 60° C. for at least 17 hr to remove the water. This produced a composite powder having graphite:PP weight ratio of 0.43 (graphite being 30% w/w).

Then, 1.67 g of the composite powder having graphite:PP ratio of 0.43, and 3.33 g of dry PP homopolymer powder (catalog number H12-F00, Ineos Group Limited, Hampshire, England) were placed into a plastic vial with a glass grinding ball, and the mixture was mechanically mixed for 10 minutes using a Spex 8000 mill/mixer manufactured by SPEX CertiPrep (Metuchen, N.J.). This produced a composite powder having a final graphite:PP ratio of 0.11.

The composite was molded by applying a temperature of about 177° C. and pressure of about 6 metric tons for about 2 minutes to produce a sheet of about 1.4 millimeter thick with a length of about 6 centimeter and a width of about 4 centimeter.

The resultant composite sheet was characterized for its electrical properties as described in Example 4.

Example 3

Preparation of Polypropylene and Graphite Nanoplatelet Composites by Mechanical Compounding In this example, the expanded graphite nanoplatelets prepared as described in Example 1 were mixed with Ineos H12-F00 dry polypropylene powders by applying a mechanical mixing using Spex 8000 mill/mixer.

The composites comprising expanded graphite nanoplatelets and PP thereby prepared in weight ratios of graphite:PP of 0.25 and 0.43 (graphite being 20 and 30% w/w respectively) were molded into composite sheets as described in Example 1.

The resultant composite sheets were tested for their electrical properties as described in Example 4.

Example 4

Electrical Characterization of Molded Composite Sheets (Table 1)

In this example, composite molded sheets prepared as described in Examples 1 through 3 were characterized for their electrical properties. The measured electrical properties included surface resistance ($R_s$) and electromagnetic interference shielding effectiveness (EMI-SE). Results of these electrical measurements are provided in Table 1. The first two columns of Table 1 indicate the compounding method and the weight ratio of graphite filler:PP in the composite sample.

Surface resistance ($R_s$) of the molded sheets was measured at nine different locations on each side of the sheet (identified in Table 1, column 3 as side "A" and side "B") using a hand-held four-point probe. The surface resistance measurements were obtained using a model RM2 electrical resistance test meter manufactured by Jandel Engineering Ltd (Leighton Buzzard, England). The maximum surface resistance this equipment is capable of measuring is $10^7\Omega$/square. Table 1 column 4 shows the percentage of locations on each sample surface that had measurable $R_s$ of less than $10^7\Omega$/square. Table 1 column 5 shows the average $R_s$ of the locations on the sample surface that had measurable $R_s$.

Electromagnetic interference shielding effectiveness (EMI-SE) of the molded sheets was measured within a frequency range of 0.3 to 1300 MHz in accordance with ASTM standard D4935-99. EMI-SE values for each measured sample are shown in Table 1, column 6 and column 7, for measurements taken at frequencies of 100 MHz and 200 MHz, respectively.

As shown in Table 1, composites prepared by the solution compounding method disclosed in this invention (Example 1) had a threshold of electrical conductivity at a graphite nanoplatelet filler:PP weight ratio around 0.11. The sample with graphite:PP weight ratio of 0.11 had measurable $R_s$ lower than $10^7\Omega$/square over at least 89% of its surfaces, but the average $R_s$ on one side of the sample was rather high at 450,000Ω/square. In contrast, samples with filler:PP weight ratios of 0.25 and 0.43 all showed measurable $R_s$ over 100% of their surfaces, and significantly lower average $R_s$. Average $R_s$ also decreased noticeably when the filler:PP ratio increased from 0.25 to 0.43. This decrease in $R_s$ is indicative of increased conductivity of the material due to the increasing amount of conductive graphite filler in the material. The $R_s$ measurements indicate that a percolation threshold was reached at a filler:PP weight ratio of about 0.11, i.e. at this loading level and above, the dispersion of filler was sufficient to provide good electrical conductivity.

Samples prepared by the solution compounding method with graphite:PP weight ratios from 0.11 to 0.43 all showed good EMI-SE greater than 30 dB at 100 and 200 MHz. Samples with graphite:PP ratio of 0.25 or greater showed especially good EMI-SE of about 50 dB or higher at 100 and 200 MHz.

The sample prepared by the solution compounding and dilution method (Example 2), with graphite:PP weight ratio of 0.11, showed surface resistance higher than $10^7\Omega$/square over its entire surface. This indicates that the concentration of graphite was not sufficient to provide electrical conductivity. However, the sample prepared in Example 2 with graphite:PP weight ratio of 0.11 still showed good EMI-SE of greater than 32 dB at 100 and 200 MHz. This indicates that, although surface resistance was high, good dispersion of graphite through the sample was achieved. This indicates further that the mixture of expanded graphite nanoplatelets and PP emulsion can be used as a masterbatch to make larger quantities of PP-GNP composites having effective EMI shielding properties with a relatively low concentration of graphite fillers.

In contrast, composites prepared by simple mechanical compounding (Example 3) had high average $R_s$ values although they had filler:PP weight ratios of 0.25 and 0.43. Moreover, these materials had measurable resistance less than $10^7\Omega$/square over only 33 to 89 percent of their surfaces. This indicates that significant portions of these materials were virtually non-conductive, and that they did not reach a percolation threshold of filler dispersion. This indicates further that the solution compounding method of this invention was substantially more effective at dispersing the carbon fillers uniformly throughout the polymer matrix. Thus, the amount of the carbon loading may be lowered by using the solution compounding method disclosed in this invention. This may lead to lower product costs and/or provide better mechanical properties (e.g. flexibility) of the composites.

The measured EMI-SE of the composites prepared by the solution compounding method of this invention was superior to that of composites prepared by the conventional mechanical compounding technique. The solution compounded composites with filler:PP weight ratios of 0.25 and 0.43 had EMI-SE between 49 and 55 dB, whereas mechanically compounded composites with similar filler amounts had significantly lower EMI-SE of 29 to 31 dB. Moreover, solution-compounded composites with only 0.11 filler:PP weight ratio had EMI-SE between about 31 and 34 dB, better shielding effectiveness than that of the mechanically compounded materials with filler:PP weight ratios of 0.25 and 0.43. This further illustrates that the solution compounding method disclosed in this invention can provide composites with considerably lower carbon loading, more uniform carbon dispersion and thereby more uniform surface electrical resistance, and superior EMI shielding effectiveness as compared to the traditional compounding methods.

TABLE 1

Properties of compression-molded composites comprising polypropylene and expanded graphite nanoplatelets.

| Compounding method | Weight Ratio of graphite nanoplatelets:polypropylene | Side of the molded sheet | Percentage of locations with Rs less than $10^7$ Ω/square | Average Rs (Ω/square) | EMI-SE @ 100 MHz (dB) | EMI-SE @ 200 MHz (dB) |
|---|---|---|---|---|---|---|
| Solution Compounding (Example 1) | 0.11 | A | 89 | 450,000 | 30.92 | 33.86 |
| | | B | 100 | 6.0 | | |
| | 0.25 | A | 100 | 1.2 | 52.97 | 53.20 |
| | | B | 100 | 0.88 | | |
| | 0.43 | A | 100 | 0.42 | 52.87 | 54.96 |
| | | B | 100 | 0.32 | | |
| | 0.43 (repeat) | A | 100 | 0.73 | 49.44 | 50.52 |
| | | B | 100 | 0.59 | | |
| Solution Compounding and Dilution (Example 2) | 0.11 | A | 0 | Not available | 32.25 | 32.65 |
| | | B | 0 | Not available | | |
| Mechanical Compounding (Example 3) | 0.25 | A | 56 | 530,000 | 30.63 | 31.43 |
| | | B | 67 | 450,000 | | |
| | 0.43 | A | 89 | 420,000 | 29.13 | 30.53 |
| | | B | 33 | 20 | | |

While the present invention has been described with reference to the specific embodiments thereof, it should be understood by those skilled in the art that various changes may be made and equivalents may be substituted without departing from the scope of the invention. In addition, many modifications may be made to adapt a particular situation, materials, compositions, processes, process step or steps, to the objective and scope of the present invention. All such modifications are intended to be within the scope of the claims appended hereto.

What is claimed is:

1. A process for preparing an electrically conductive composite comprising the steps of:

obtaining a polymer emulsion comprising a polymer in a liquid solvent, wherein said polymer is polypropylene or polyethylene;

mixing non-predispersed carbon with the polymer emulsion to obtain a dispersion of the carbon within the polymer matrix, wherein the weight ratio of carbon to the polymer is from greater than 0.11 to about 1.5; and removing the liquid solvent from the dispersion, whereby an electrically conductive composite having the weight ratio of the carbon to the polymer of from greater than 0.11 to about 1.5 is obtained.

2. The process according to claim 1, wherein said carbon is graphite, carbon fibers, carbon nanotubes, or a mixture thereof.

3. The process according to claim 2, wherein said carbon is expanded graphite nanoplatelets.

4. The process according to claim 1, wherein said polymer is polyethylene.

5. The process according to claim 1, wherein said polymer is polypropylene.

6. The process according to claim 1, wherein the weight ratio of carbon to polymer is about 0.25-1.0.

7. The process according to claim 1, wherein the weight ratio of carbon to polymer is about 0.25-0.43.

8. The process according to claim 1, wherein the liquid is water.

9. The process according to claim 1, wherein the mixing is by mechanical agitation or by sonication.

10. The process according to claim 1, wherein the weight ratio of the carbon to polymer is about 0.25-1.5.

11. A process for preparing an electrically conductive composite comprising the steps of:

obtaining a mixture comprising non-predispersed carbon and a polymer emulsion comprising a polymer in a liquid solvent, wherein said polymer is polypropylene or polyethylene, and the weight ratio of carbon to the polymer is greater than 0.11;

mixing the carbon with the emulsion to obtain a dispersion of the carbon with the polymer matrix; and removing the liquid solvent from the dispersion, whereby an electrically conductive composite having the weight ratio of the carbon to the polymer of greater than 0.11 is obtained.

12. The process according to claim 11, wherein said carbon is graphite, carbon fibers, carbon nanotubes, or a mixture thereof.

13. The process according to claim 12, wherein said carbon is expanded graphite nanoplatelets.

14. The process according to claim 11, wherein said polymer is polypropylene.

15. The process according to claim 11, wherein the weight ratio of carbon to polymer is about 0.25-1.5.

16. The process according to claim 11, wherein the weight ratio of carbon to polymer is about 0.25-1.0.

17. The process according to claim 11, wherein the weight ratio of carbon to polymer is about 0.25-0.43.

18. The process according to claim 11, wherein said polymer is polyethylene.

* * * * *